US005697812A

United States Patent [19]

Sampson et al.

[11] Patent Number: 5,697,812

[45] Date of Patent: Dec. 16, 1997

[54] BOARD-MOUNTED ELECTRICAL CONNECTOR

[75] Inventors: Stephen A. Sampson, Downers Grove; Paul A. Reisdorf, LaGrange, both of Ill.; Timothy Scott Elo, Hammond, Ind.

[73] Assignee: Molex Incorporated, Lisle, Ill.

[21] Appl. No.: 663,827

[22] Filed: Jun. 14, 1996

[51] Int. Cl.[6] ..... H01R 13/60

[52] U.S. Cl. ..... 439/567; 439/557

[58] Field of Search ..... 439/567, 557, 439/571, 572

[56] References Cited

U.S. PATENT DOCUMENTS

| | | | |
|---|---|---|---|
| 4,477,142 | 10/1984 | Cooper et al. | 336/125 |
| 4,668,040 | 5/1987 | Matsuzaki et al. | 439/567 |
| 4,953,061 | 8/1990 | Nitkiewicz | 361/417 |
| 5,071,371 | 12/1991 | Harwath et al. | 439/637 |
| 5,112,235 | 5/1992 | Enomoto et al. | 439/857 |

FOREIGN PATENT DOCUMENTS

| | | |
|---|---|---|
| 0271231B1 | 3/1993 | European Pat. Off. . |
| 63-116975 | 7/1988 | Japan . |

*Primary Examiner*—Neil Abrams
*Assistant Examiner*—T. C. Patel
*Attorney, Agent, or Firm*—Stacey E. Caldwell

[57] ABSTRACT

An electrical connector is adapted for mounting on a printed circuit board. The connector includes a dielectric housing having a mating face and a board-mounting face. At least one mounting post projects from the board-mounting face for insertion into a mounting hole in the printed circuit board. The mounting post is bifurcated lengthwise thereof and includes a relatively rigid leg of a substantially C-shaped cross section defining a slot extending longitudinally thereof. A relatively flexible leg includes a latch for latching engagement with the printed circuit board at the mounting hole. The flexible leg is sized for flexing movement substantially into the slot in the C-shaped rigid leg. Therefore, the C-shaped rigid leg provides an overstress protection for the flexible leg.

15 Claims, 3 Drawing Sheets

BOARD-MOUNTED ELECTRICAL CONNECTOR

FIELD OF THE INVENTION

This invention generally relates to the art of electrical connectors and, particularly, to an electrical connector adapted for mounting on a printed circuit board.

BACKGROUND OF THE INVENTION

Printed circuit board electrical connectors are widely known in the electronics industry. They provide a connectable interface between the printed circuit board and another connectable electrical connector device. They also may provide an interface between the board on which the connector is mounted and a second printed circuit board. In whatever application, the primary board-mounted connector includes some form of board mounting means for holding or locking the connector to its printed circuit board.

One form of mounting means typically used in the electronics industry is to provide separate boardlocks between the connector and the printed circuit board. These separate boardlocks often are fabricated of metal material and are mounted on or otherwise secured to the connector housing which is inexpensively molded of dielectric material such as plastic or the like. In a few instances, the separate boardlocks may be provided by plastic clips. Regardless of whether the separate boardlocks are of metal material or in the form of plastic clips, they add considerably to the costs of manufacturing the electrical connector.

More cost-effective mounting means are provided by mounting posts molded integrally with the dielectric housing of the connector. The mounting posts are inserted into mounting holes in the printed circuit board. Such mounting posts have taken a wide variety of configurations. However, regardless of the configuration of the mounting post, a design dilemma typically occurs between providing high retention forces with respect to the circuit board and providing low insertion forces in mounting the connector to the board. In other words, a mounting post could be designed to be robust and rigid to ensure the connector is completely secured to the circuit board, but the insertion forces required to insert the post into its mounting hole would be undesirable. Similarly, providing extremely low insertion force mounting posts often results in a corresponding low retention force of the connector to the board. Further design considerations of the post include strength and resistance to breakage during shipment and assembly. The design of such mounting posts usually are concentrated on balancing all of these factors.

For instance, it is known to provide a mounting post with a substantially C-shaped cross section, with or without latching hooks or barbs for latching to an opposite side of the printed circuit board. Such C-shaped mounting posts provide a high degree of reliability because of their low breakage experience. However, such C-shaped mounting posts often require far greater insertion forces than are desired or are required for particular specifications.

Another design of a mounting post is to provide the post with a bifurcated configuration which defines two generally parallel legs separated by a slot. One leg may be more rigid than the second leg which includes a board latch or hook. In other words, the first leg provides rigidity and the second leg provides the necessary locking or latching flexibility. One problem associated with the bifurcated leg type of mounting post is that the flexible leg often becomes caught on extraneous objects, particularly during shipping and handling, resulting in a high degree of breakage or damage to the post under those conditions.

The present invention is directed to solving the above problems by providing an improved structure for a mounting post for mounting an electrical connector of the character described to a printed circuit board.

SUMMARY OF THE INVENTION

An object, therefore, of the invention is to provide a new and improved electrical connector adapted for mounting on a printed circuit board, and particularly to a mounting post structure for the connector.

In the exemplary embodiment of the invention, the connector includes a dielectric housing having a mating face and a board-mounting face. At least one mounting post projects from the board-mounting face for insertion into a mounting hole in the printed circuit board. The mounting post is bifurcated lengthwise thereof and includes a relatively rigid leg of a substantially C-shaped cross section. The C-shaped rigid leg thereby defines a slot or gap extending longitudinally therealong. The mounting post further includes a relatively flexible leg with a latching surface formed thereon for latching engagement with the printed circuit board at the mounting hole. The flexible leg is sized for flexing movement substantially into the slot of the C-shaped rigid leg. Therefore, the rigid leg provides protection and an anti-overstress structure for the flexible leg.

As disclosed herein, the C-shaped rigid leg has an outside diameter smaller than that of the mounting hole in the printed circuit board. The latching surface on the flexible leg is provided by an outwardly projecting hook for latching engagement with a side of the printed circuit board opposite an insertion side of the board. The inside surface of the flexible leg is tapered toward a distal end of the flexible leg. The outside surface of the flexible leg is tapered at a distal end thereof, beneath the outwardly projecting hook, for facilitating guiding the mounting post into the mounting hole.

A feature of the invention involves the specific configuration of the flexible leg of the bifurcated mounting post. In particular, the flexible leg is generally T-shaped in cross section, defining a leg brace of the T-shape projecting into the slot of the C-shaped rigid leg of the mounting post and a cross brace of the T-shape extending in a generally circumferential direction relative to the C-shaped rigid leg. The inside surface of the leg brace of the T-shaped flexible leg is tapered toward a distal end of the flexible leg to provide flexibility in the leg. The sides of the cross brace of the T-shape are flared outwardly. The edges of the rigid leg at the slot are angled complementary to the flared configuration of the sides of the cross brace of the T-shaped flexible leg.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
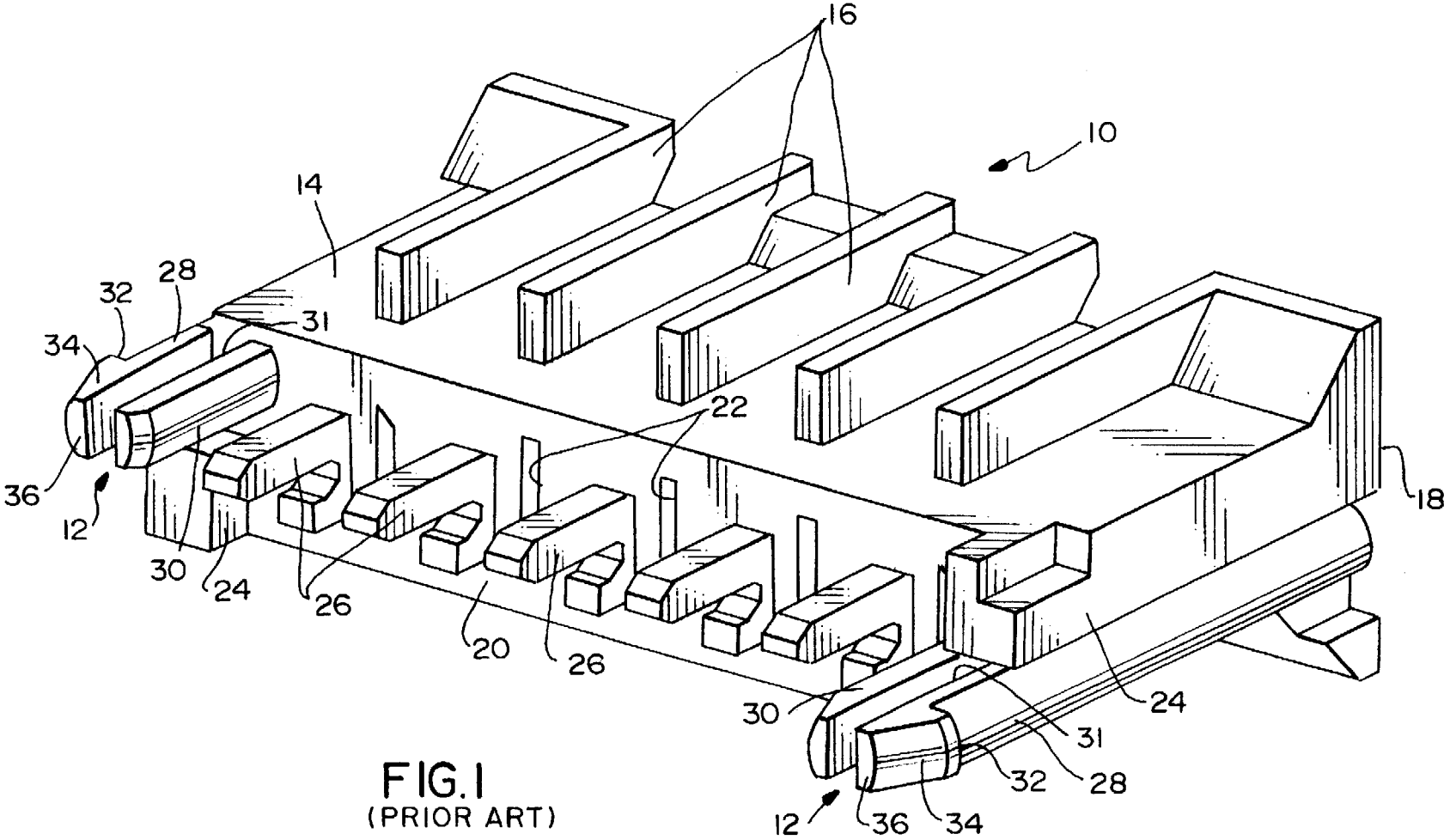
FIG. 1 (PRIOR ART)
FIG. 1 is a perspective view looking toward the board-mounting face of an electrical connector having mounting posts according to the prior art.

Referring to the drawings in greater detail, and first to FIG. 1,. an electrical connector, generally designated 10, is shown to include a pair of mounting posts, generally designated 12, according to the prior art. Connector 10 includes a unitary housing 14 molded of dielectric material such as plastic or the like. The housing is molded with a plurality of stiffening ribs 16 on the outside thereof. Basically, the housing defines a mating face 18 and a board-mounting face 20. A plurality of slots 22 extend through the board-mounting face and act as drain holes during processing of the connector. A pair of standoffs 24 are molded integrally with the housing and project beyond board-mounting face for engaging a printed circuit board and spacing the housing from the board. Lastly, a plurality of terminals 26 are mounted within housing 14 and extend beyond board-mounting face 20. The terminals are longer than standoffs 24 for insertion into appropriate holes in the printed circuit board for electrical connection to circuit traces on the board and/or in the holes by soldering, for example.

Each prior art mounting post 12 of connector 10 (FIG. 1) is of a bifurcated configuration to define a locking leg 28 and a backing leg 30 with a slot 32 extending longitudinally therebetween. The locking leg includes an outwardly projecting hook 31 for latching engagement with a side of the printed circuit board opposite an insertion side of the board. An outer surface 34 of leg 28 is tapered between a distal end 36 of the leg and hook 32 to facilitate inserting the bifurcated mounting post into an appropriate mounting hole in the printed circuit board. The outer surface of backing leg 30 may also be tapered to facilitate insertion of the post into the hole.

In operation of mounting posts 12 of the prior art, as the mounting posts are inserted into their respective mounting holes in the printed circuit board, each locking leg 28 is biased inwardly toward the respective backing leg 30 until hook 32 of locking leg 28 clears the opposite side of the printed circuit board, whereupon locking leg 28 will snap back outwardly to lock the connector to the board. Often, the locking leg is more resilient than the backing leg so that the locking leg is more flexible.

Figure 2:
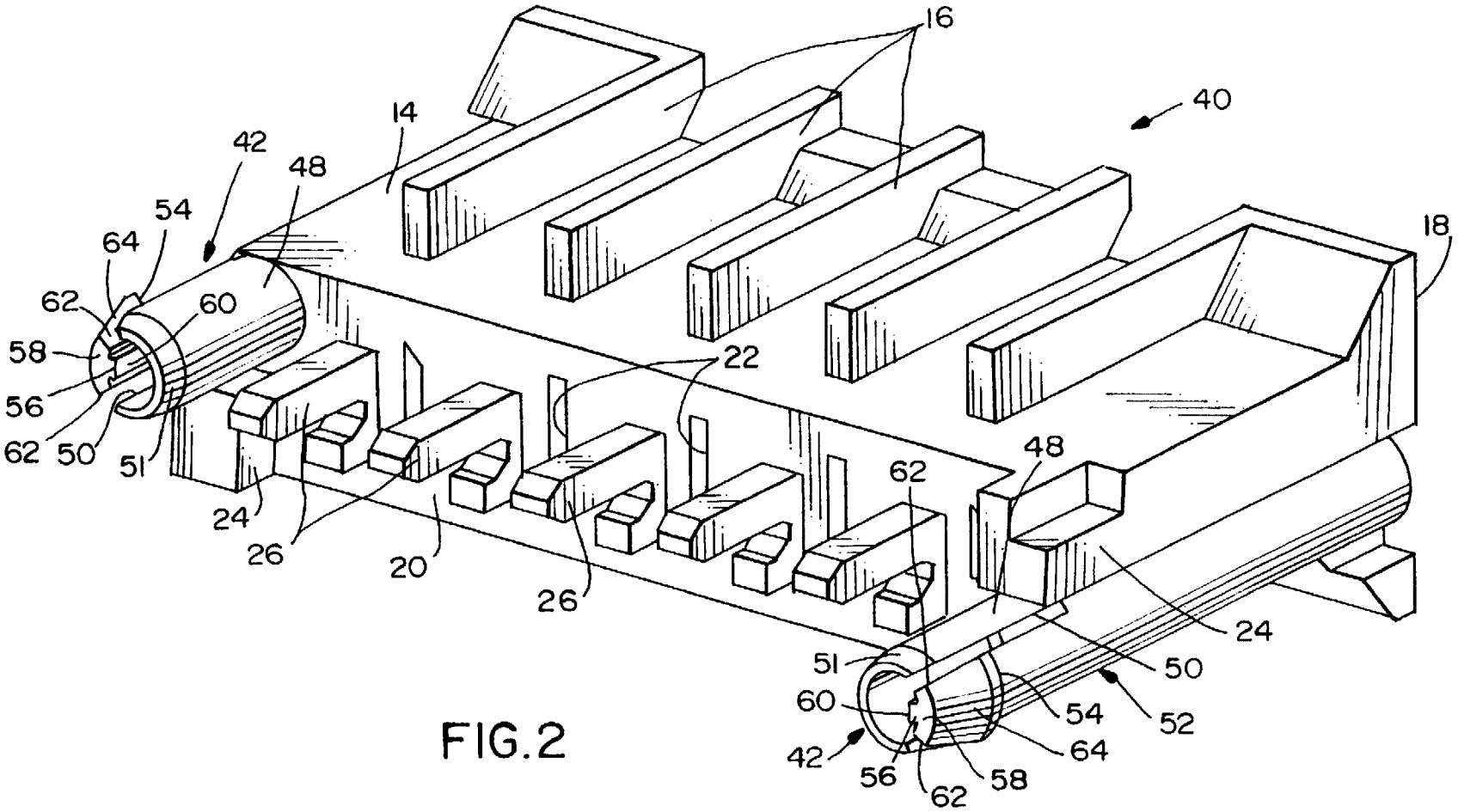
FIG. 2 is a perspective view looking toward the board-mounting face of an electrical connector incorporating the mounting posts of the invention.
Figure 3:
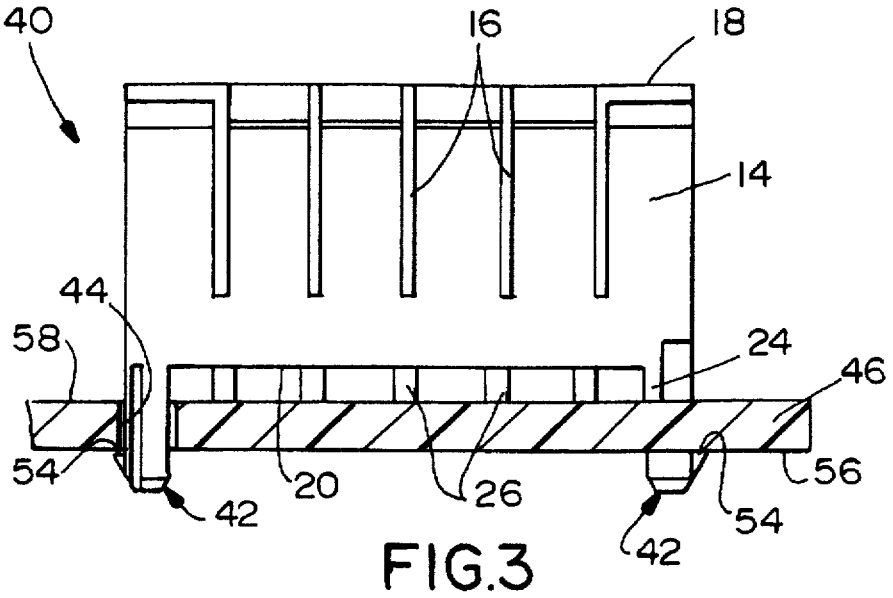
FIG. 3 is a side elevational view of the connector housing mounted on a printed circuit board, shown in section.

FIG. 2 shows an electrical connector, generally designated 40, incorporating a pair of mounting posts, generally designated 42, according to the invention. The posts project from board-mounting face 20 of housing 14, and like numerals have been applied in FIG. 2 to designate components of the connector housing or terminals corresponding to like components described above in relation to connector 10 in FIG. 1. Mounting posts 42 are adapted for insertion into appropriate mounting holes 44 in a printed circuit board 46 as shown in FIG. 3. It can be seen how standoffs 24 space housing 14 above the printed circuit board.

Figure 5:
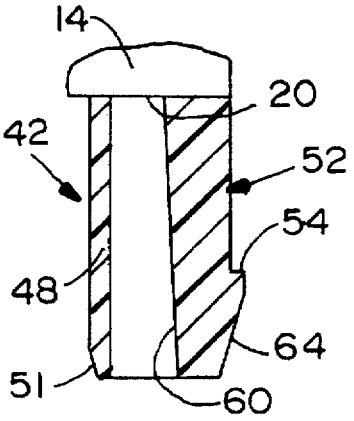
FIG. 5 is a vertical section taken generally along line 5—5 of FIG. 4.
Figure 4:
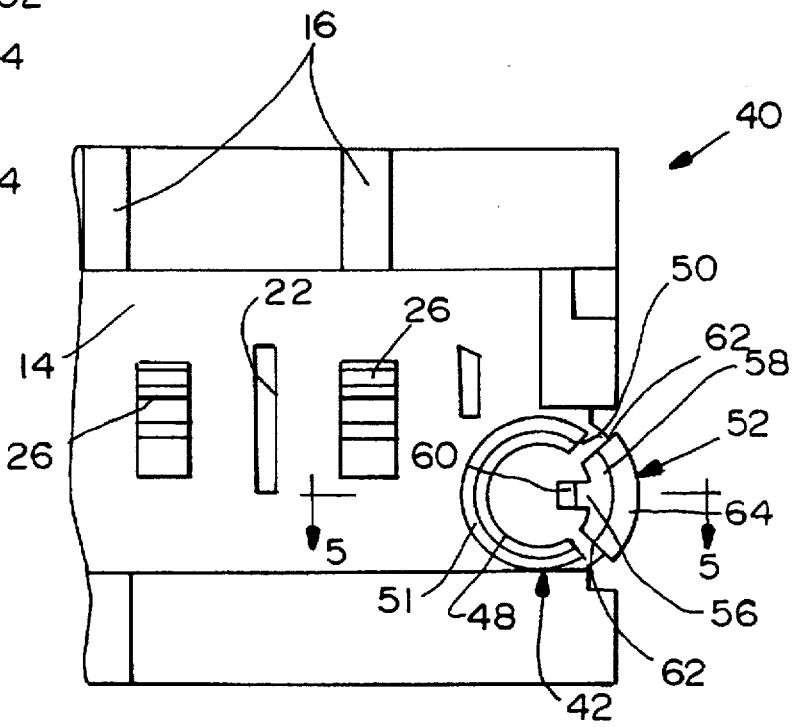
FIG. 4 is a fragmented bottom plane view of the connector housing, showing a bottom axial view of one of the mounting posts.

Referring to FIGS. 4 and 5 in conjunction with FIG. 1, each mounting post 42 is bifurcated lengthwise thereof to define a relatively rigid leg 48 having a substantially C-shaped cross section (FIG. 4) thereby defining a circumferential slot or gap 50 extending longitudinally along the rigid leg. A distal end of C-shaped rigid leg 48 is tapered, as at 51, to facilitate inserting mounting post 42 into its respective mounting hole in the printed circuit board. Each bifurcated mounting post 42 also includes a relatively flexible leg, generally designated 52, having a latching surface in the form of an outwardly projecting hook 54 for latching engagement with a side 56 (FIG. 3) of printed circuit board 46 opposite an insertion side 58 of the board. Generally, flexible leg 52 is sized for flexing movement substantially into slot 50, whereby the C-shaped rigid leg provides protection and an anti-overstress means for flexible leg 52. The C-shaped rigid leg also provides protection against the flexible leg becoming caught on extraneous objects during shipping or handling.

Flexible leg 52 of each mounting post 42 has a unique cross sectional configuration such that it acts as a T-beam construction. More particularly, the flexible leg is generally T-shaped in cross section (FIG. 4) to define a leg brace 56 of the T-shape projecting in toward the center of the C-shaped rigid leg 48, as well as a cross brace 58 extending in a generally circumferential direction relative to the C-shaped rigid leg. The inside surface 60 of leg brace 56 of the T-shaped flexible leg is tapered toward the distal end of the flexible leg (FIG. 5). This taper allows the peg to be most flexible at its distal end and therefore facilitate insertion of the peg into a circuit board, yet remain robust at its board mounting face due to the increase in material. The sides 62 of cross brace 58 of the T-shaped flexible leg are flared outwardly. Correspondingly, the edges of rigid leg 48 at slot 50 are angled complementary to the flared configuration of sides 62 of cross brace 58 of the T-shaped leg 52, as shown most clearly in FIG. 4.

Lastly, the outside surface of flexible leg 52, as at 64 between the distal end of the flexible leg and hook 54, is tapered as best seen in FIGS. 2 and 5. This facilitates guiding the mounting post into the respective mounting hole 44 in printed circuit board 46.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector adapted for mounting on a printed circuit board, comprising:

a dielectric housing having a mating face and a board-mounting face; and at least one mounting post projecting from the board-mounting face for insertion into a mounting hole in the printed circuit board, the mounting post being bifurcated lengthwise thereof and including a relatively rigid leg of a substantially C-shaped cross section defining a slot extending longitudinally thereof, and a relatively flexible leg having a latching surface for latching engagement with the printed circuit board at said mounting hole, the flexible leg being sized for flexing movement substantially into the slot of the C-shaped rigid leg, whereby the C-shaped rigid leg provides overstress protection for the flexible leg.

2. The electrical connector of claim 1 wherein said latching surface on the flexible leg comprises an outwardly projecting hook for latching engagement with a side of the printed circuit board opposite an insertion side of the board.

3. The electrical connector of claim 1 wherein an inside surface of the flexible leg is tapered toward a distal end of the flexible leg.

4. The electrical connector of claim 1 wherein an outside surface of the flexible leg is tapered at a distal end thereof for facilitating guiding the mounting post into the mounting hole.

5. The electrical connector of claim 1 wherein said flexible leg is generally T-shaped in cross section defining a leg brace of the T-shape projecting into the slot defined by the C-shaped rigid leg and a cross brace of the T-shape extending in a generally circumferential direction relative to the C-shaped rigid leg.

6. The electrical connector of claim 5 wherein the inside surface of the leg brace of the T-shaped flexible leg is tapered toward a distal end of the flexible leg.

7. The electrical connector of claim 5 wherein the sides of the cross brace of the T-shape are flared outwardly.

8. The electrical connector of claim 7 wherein the edges of the rigid leg at said slot are angled complementary to the flared configuration of the sides of the cross brace of the T-shaped flexible leg.

9. An electrical connector adapted for mounting on a printed circuit board, comprising:

a dielectric housing having a mating face and board-mounting face; and at least one mounting post projecting from the board-mounting face for insertion into a mounting hole in the printed circuit board, the mounting post being bifurcated lengthwise thereof and including a relatively rigid leg of a substantially C-shaped cross section defining a slot extending longitudinally therealong with the rigid leg having an outside diameter smaller than that of the mounting hole in the printed circuit board, and a relatively flexible leg having an outwardly projecting hook for latching engagement with a side of the printed circuit board opposite an insertion side of the board, the flexible leg being generally T-shaped in cross section defining a leg brace of the T-shape projecting into the slot defined by the C-shaped rigid leg and a cross brace of the T-shape extending in a generally circumferential direction relative to the C-shaped rigid leg.

10. The electrical connector of claim 9 wherein the inside surface of the leg brace of the T-shaped flexible leg is tapered toward a distal end of the flexible leg.

11. The electrical connector of claim 9 wherein an outside surface of the flexible leg, between a distal end of the leg and said outwardly projecting hook, is tapered for facilitating guiding the mounting post into the mounting hole.

12. The electrical connector of claim 9 wherein the sides of the cross brace of the T-shape are flared outwardly.

13. The electrical connector of claim 12 wherein the edges of the rigid leg at said slot are angled complementary to the flared configuration of the sides of the cross brace of the T-shaped flexible leg.

14. An electrical connector adapted for mounting on a printed circuit board, comprising:

a dielectric housing having a mating face and board-mounting face; and at least one mounting post projecting from the board-mounting face for insertion into a mounting hole in the printed circuit board, the mounting post being bifurcated lengthwise thereof and including a relatively rigid leg and a relatively flexible leg separated by a slot extending longitudinally of the mounting post, the relatively flexible leg having a latching surface for latching engagement with the printed circuit board at said mounting hole, and the relatively flexible leg being generally T-shaped in cross section defining a leg brace of the T-shape projecting in a generally radial direction and cross brace of the T-shape extending in a generally circumferential direction relative to the mounting hole.

15. The electrical connector of claim 14 wherein the inside surface of the leg brace of the T-shaped flexible leg is tapered toward a distal end of the flexible leg.

* * * * *